US010018956B2

(12) United States Patent
Kawabata et al.

(10) Patent No.: US 10,018,956 B2
(45) **Date of Patent: *Jul. 10, 2018**

(54) CLEANING BLADE

(71) Applicants: NOK CORPORATION, Tokyo (JP); SYNZTEC CO., LTD., Tokyo (JP)

(72) Inventors: Syo Kawabata, Kanagawa (JP); Kenji Sasaki, Kanagawa (JP); Katsumi Abe, Kanagawa (JP); Natsumi Kimura, Kanagawa (JP)

(73) Assignees: NOK CORPORATION, Tokyo (JP); SYNZTEC CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/315,120

(22) PCT Filed: Feb. 12, 2016

(86) PCT No.: PCT/JP2016/054056

§ 371 (c)(1),
(2) Date: Nov. 30, 2016

(87) PCT Pub. No.: WO2016/133006

PCT Pub. Date: Aug. 25, 2016

(65) Prior Publication Data

US 2017/0199492 A1 Jul. 13, 2017

(30) Foreign Application Priority Data

Feb. 16, 2015 (JP) ..... 2015-027906

(51) Int. Cl.
*G03G 21/00* (2006.01)

(52) U.S. Cl.
CPC ..... *G03G 21/0017* (2013.01)

(58) Field of Classification Search
None
See application file for complete search history.

(56) References Cited

U.S. PATENT DOCUMENTS 9,665,061 B2 * 5/2017 Kimura ..... G03G 21/0017
2012/0163890 A1 * 6/2012 Uematsu ..... G03G 21/0017 399/350

FOREIGN PATENT DOCUMENTS

JP 2007039678 A * 2/2007

* cited by examiner

*Primary Examiner* — Thomas Giampaolo, II
(74) *Attorney, Agent, or Firm* — Young & Thompson

(57) ABSTRACT

A cleaning blade has an elastic body formed of a urethane elastomer, and a treated surface layer formed at least at a portion which comes into contact with a contact target of the elastic body. The treated surface layer is formed through impregnating a surface portion of the elastic body with a surface treatment liquid containing a bifunctional isocyanate compound, at least one polyol, and an organic solvent; or a surface treatment liquid containing an isocyanate group-containing compound having an isocyanate group at an end thereof, which compound is a reaction product of the bifunctional isocyanate compound with the at least one polyol, and an organic solvent, and curing the surface treatment liquid. The difference between the nitrogen concentration at the surface and the nitrogen concentration in the elastic body at a depth of 0.5 mm from the surface of the treated surface layer is 0.02 to 0.15 mass %.

8 Claims, 1 Drawing Sheet

CLEANING BLADE

TECHNICAL FIELD

The present invention relates to a cleaning blade for use in an image-forming device such as an electrophotographic copying machine or printer, or a toner-jet copying machine or printer.

BACKGROUND ART

In a typical electrophotographic process, an electrophotographic photoreceptor undergoes steps essentially including cleaning, charging, light exposure, developing, and image-transfer. In the electrophotographic process, a cleaning blade is employed to scrape off toner remaining on the surface of an electrostatic latent image carrier such as a photoreceptor. From the viewpoints of plastic deformation and wear resistance, the cleaning blade is generally formed of a thermosetting polyurethane elastomer.

However, when a cleaning blade formed of a polyurethane elastomer is employed, the friction coefficient between the blade member and a photoreceptor drum increases, and delamination of the blade and anomalous sound problematically occur. Also, the driving torque of the photoreceptor drum must be increased in some cases. Furthermore, the edge of the cleaning blade may be wound to a photoreceptor drum or another member, whereby the cleaning blade is stretched or cut, and the edge of the cleaning blade is broken due to wear. These problems become severe particularly when the cleaning blade has low hardness. As a result, the durability of the cleaning blade is impaired.

In order to solve the aforementioned problems, the contact portion of a polyurethane blade has been modified to have high hardness and low friction. In one proposed procedure, a polyurethane blade is impregnated with an isocyanate compound, to thereby induce reaction between the polyurethane and the isocyanate compound, whereby the hardness is enhanced at only the surface or a portion near the surface, and wear of the surface is reduced (see, for example, Patent Documents 1 and 2).

However, in order to attain a target surface hardness, in the blades disclosed in Patent Documents 1 and 2, a polyurethane body must be impregnated with a surface treatment liquid having high isocyanate compound concentration, to thereby form a thick treated surface layer. For forming such a thick treated surface layer, an excess amount of isocyanate is unavoidably applied to the blade surface. Thus, the excess amount of isocyanate must be removed. In contrast, when the thickness of the treated surface layer is reduced, neither a target surface hardness nor low friction can be attained. In this case, wear resistance and delamination resistance cannot be fully attained, which is problematic.

Meanwhile, in order to enhance wear resistance, there has been proposed a blade having a contact portion in which nitrogen concentration continuously increases from the inside thereof to the surface thereof (see, for example, Patent Document 3). However, the blade disclosed in Patent Document 3 has a large difference in nitrogen concentration between the inside and the surface of the contact portion, and the nitrogen concentration is relatively high at the surface of the contact portion. Therefore, similar to the blades disclosed in Patent Documents 1 and 2, a step of removing isocyanate is required. In addition, due to a large difference in nitrogen concentration between the inside and the surface of the contact portion, the flexibility of the blade is lost, to thereby fail to ensure long-term cleaning performance, which is also problematic.

Under such circumstances, there has been proposed a technique in which the amount of an isocyanate compound caused to be present at the contact portion is adjusted to an appropriate level, thereby omitting the isocyanate compound remaining at the surface after impregnation, whereby the hardness of the top surface portion of the contact portion can be effectively elevated, and rubber elasticity can be ensured in a portion near the contact surface (see, Patent Document 4).

However, even when the technique disclosed in Patent Document 4 is employed, when the hardness of the contact portion is sufficiently enhanced, the impregnation amount unavoidably increases. Thus, flexibility in the vicinity of the contact portion is impaired, to thereby cause warpage at the contact portion, and the surface of the contact portion is coated with the remaining surface treatment liquid, which are also problematic. As a result, problematically, the blade body must be wiped after surface treatment or cutting, and consistent surface treatment fails to be attained.

PRIOR ART DOCUMENTS

Patent Documents

Patent Document 1: Japanese Patent Application Laid-Open (kokai) No. 2007-052062
Patent Document 2: Japanese Patent Application Laid-Open (kokai) No. 2004-280086
Patent Document 3: Japanese Patent Application Laid-Open (kokai) No. 2009-025451
Patent Document 4: Japanese Patent Application Laid-Open (kokai) No. 2012-137516

SUMMARY OF THE INVENTION

Problems to be Solved by the Invention

In view of the foregoing, an object of the present invention is to provide a cleaning blade which maintains flexibility of the blade, which has high hardness effectively realized only at the surface, which does not require formation of a coating layer on the surface, and which ensures excellent cleaning performance for a long period of time.

Means for Solving the Problems

In one mode of the present invention to solve the aforementioned problems, there is provided a cleaning blade having an elastic body formed of a urethane elastomer, and a treated surface layer formed at least at a portion which comes into contact with a contact target of the elastic body, characterized in that:

the treated surface layer is formed through impregnating a surface portion of the elastic body with a surface treatment liquid containing a bifunctional isocyanate compound, at least one polyol selected from a bifunctional polyol and a trifunctional polyol, and an organic solvent; or a surface treatment liquid containing an isocyanate group-containing compound having an isocyanate group at an end thereof, which compound is a reaction product of the bifunctional isocyanate compound with said at least one polyol selected from a bifunctional polyol and a trifunctional polyol, and an organic solvent, and curing the surface treatment liquid; and the difference between the nitrogen concentration at the surface of the treated surface layer and the nitrogen concentration in the elastic body at a depth of 0.5 mm from the surface of the treated surface layer is 0.02 to 0.15 mass %.

Preferably, the treated surface layer has a thickness of 10 μm to 100 μm.

Preferably, the bifunctional isocyanate compound of the surface treatment liquid has a molecular weight of 200 to 300, and each of the bifunctional polyol and the trifunctional polyol of the surface treatment liquid has a molecular weight of 150 or lower.

Preferably, the ratio of isocyanate groups present in the bifunctional isocyanate compound of the surface treatment liquid to hydroxyl groups present in at least one species selected from the bifunctional polyol and the trifunctional polyol (NCO groups/OH groups) is 1.0 to 1.5.

Preferably, the surface treatment liquid contains the bifunctional polyol and the trifunctional polyol, and the ratio in functional group number of bifunctional polyol to trifunctional polyol (number of bifunctional groups/number of trifunctional groups) is 50/50 to 95/5.

Effects of the Invention

The present invention realizes a cleaning blade which maintains flexibility of the blade, which has high hardness effectively realized only at the surface, which does not require formation of a coating layer on the surface, and which ensures excellent cleaning performance for a long period of time.

MODES FOR CARRYING OUT THE INVENTION

Figure 1:
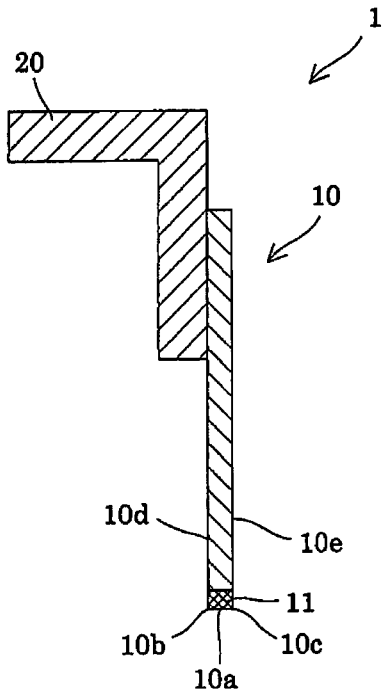
FIG. 1 A cross-section of an example of the cleaning blade of the present invention.

The cleaning blade of the present invention will next be described in detail.

(Embodiment 1)

As shown in FIG. 1, a cleaning blade 1 has an elastic body 10 and a supporting member 20. The elastic body 10 is joined to the supporting member 20 by the mediation of an adhesive not illustrated in FIG. 1. The elastic body 10 is formed of a urethane elastomer molded body. The elastic body 10 has a treated surface layer 11 formed on the surface portion thereof. The treated surface layer 11 is formed by impregnating the surface portion of the elastic body 10 with a surface treatment liquid, and curing the liquid. The treated surface layer 11 may be provided on a contact portion of the elastic body 10 with respect to a cleaning target. In embodiment 1, the treated surface layer 11 is formed in the surface portion of the entire end face of the elastic body 10. Note that, in the present specification, the elastic body 10 without the supporting member 20 may also be referred to as a cleaning blade.

The treated surface layer 11 is formed by use of a surface treatment liquid containing a bifunctional isocyanate compound, at least one polyol selected from a bifunctional polyol and a trifunctional polyol, and an organic solvent; or a surface treatment liquid containing an isocyanate group-containing compound having an isocyanate group at an end thereof, which compound is a reaction product of the bifunctional isocyanate compound with said at least one polyol selected from a bifunctional polyol and a trifunctional polyol, and an organic solvent.

In this treatment, the surface treatment liquid efficiently reacts with the elastic body 10, to thereby form a high-crosslinking-density structure. As a result, curing is more effectively accelerated even at a low impregnation rate, as compared with the case of use of only an isocyanate compound.

Thus, the surface hardness of the cleaning blade can be sufficiently elevated without elevating the surface treatment liquid impregnation amount. The difference between the nitrogen concentration at the surface of the treated surface layer 11 and the nitrogen concentration in the elastic body at a depth of 0.5 mm from the surface of the treated surface layer 11 (i.e., in the non-surface-treated elastic body 10) is 0.02 to 0.15 mass %. Such a difference in nitrogen concentration is smaller, as compared with the case where surface treatment is performed by use of a surface treatment liquid containing a typical isocyanate compound. However, the hardness of the treated surface layer 11 is satisfactory. The treated surface layer 11 is formed such that the nitrogen concentration gradually decreases from the surface to the inside of the elastic body along the thickness direction. Since the treated surface layer 11 is formed by use of a surface treatment liquid having the aforementioned composition, sufficient hardness can be attained even at relatively low concentration of the surface treatment liquid.

The portion of the elastic body 10 where the treated surface layer 11 is formed includes at least a portion which comes into contact with a target body. The portion of contact with the target body is a width-direction corner 10*b* or 10*c* located at an end face 10*a* of the elastic body 10. Thus, the elastic body may be impregnated with the surface treatment liquid from the end face 10*a* to the inside along a direction in parallel to the end face 10*a*. Alternatively, the elastic body may be impregnated with the surface treatment liquid from a side surface 10*d* or 10*e* including the corner 10*b* or 10*c* to be employed along a direction in parallel to the end face 10*a*. Still alternatively, the elastic body may be impregnated with the surface treatment liquid from the corner 10*b* or 10*c* to the inside. In embodiment 1, the treated surface layer 11 is formed from the end face 10*a* to the inside. The position at a depth of 0.5 mm in the elastic body from the surface of the treated surface layer 11 varies depending on the method of forming the treated surface layer 11. However, in embodiment 1, the position is located at a depth of 0.5 mm from the end face 10*a*. Notably, in an alternative process, the treated surface layer may be formed on one or both surfaces, or the entire surface of the elastic body 10 before cutting into blades, after which the elastic body is cut into blades.

Through formation of the treated surface layer 11 by use of the aforementioned surface treatment liquid, the treated surface layer 11 is provided in the surface portion of the elastic body 10 preferably having a thickness of 10 μm to 100 μm, whereby the hardness of the contact portion is satisfactorily ensured. When the thickness of the treated surface layer 11 is smaller than 10 μm, impregnation with the surface treatment liquid for realizing high hardness and low wear cannot fully be attained. In this case, the torque between a contact target (e.g., a photoreceptor) and the cleaning blade increases. When the thickness of the treated surface layer 11 is greater than 100 μm, the total flexibility of the cleaning blade decreases, and break-through of toner is caused by damage (e.g., wear or chipping) of the blade, resulting in cleaning failure. Thus, the thickness of the treated surface layer 11 is suitably 10 μm to 100 μm. Through formation of the treated surface layer 11 so as to have the above thickness, the total flexibility of the elastic body 10 cannot be impaired, and only the surface portion of the elastic body 10 can be hardened.

As described above, when the treated surface layer 11 is formed at a small impregnation amount, favorable cleaning performance of the produced cleaning blade can be ensured. In addition, since the treated surface layer 11 according to the present invention is formed so as to have a very small thickness, formation of a coating layer on the surface of the elastic body 10, which would otherwise be caused by the remaining surface treatment liquid, can be prevented. Thus, a step of removing a coating layer (e.g., wiping to remove a coating layer) is not required in the procedure of producing the elastic body 10.

As described above, the surface treatment liquid used for forming the treated surface layer 11 is a liquid mixture containing a bifunctional isocyanate compound, at least one polyol selected from a bifunctional polyol and a trifunctional polyol, and an organic solvent; or a liquid mixture containing an isocyanate group-containing compound having an isocyanate group at an end thereof (i.e., a prepolymer), which compound is a reaction product of the bifunctional isocyanate compound with said at least one polyol selected from a bifunctional polyol and a trifunctional polyol, and an organic solvent. These surface treatment liquids are appropriately chosen in consideration of wettability to the elastic body 10, the degree of impregnation, the shelf life of the surface treatment liquid, etc.

Examples of the bifunctional isocyanate compound include 4,4'-diphenylmethane diisocyanate (MDI), isophorone diisocyanate (IPDI), 4,4'-dicyclohexylmethane diisocyanate (H-MDI), trimethylhexamethylene diisocyanate (TMHDI), tolylene diisocyanate (TDI), carbodiimide-modified MDI, polymethylenepolyphenyl polyisocyanate, 3,3-dimethyldiphenyl-4,4'-diisocyanate (TODI), naphthylene diisocyanate (NDI), xylene diisocyanate (XDI), lysine diisocyanate methyl ester (LDI), dimethyl diisocyanate, oligomers thereof, and modified products thereof.

Among such bifunctional isocyanate compounds, a bifunctional isocyanate compound having a molecular weight of 200 to 300 is preferably used. Among the aforementioned isocyanate compounds, 4,4'-diphenylmethane diisocyanate (MDI) and 3,3-dimethyldiphenyl-4,4'-diisocyanate (TODI) are preferably used. When a bifunctional isocyanate compound having a molecular weight of 200 to 300 is used, reaction between the bifunctional isocyanate compound and the below-mentioned at least one species selected from among a bifunctional polyol and a trifunctional polyol reliably proceeds, whereby the surface portion of the elastic body 10 can be impregnated with the surface treatment liquid in a short period of time.

Meanwhile, the bifunctional isocyanate compound has high affinity to a urethane elastomer which forms the elastic body 10, to thereby enhance integral joining of the treated surface layer 11 to the elastic body 10. When the trifunctional isocyanate compound is used, reaction between the trifunctional polyol and polyurethane proceeds excessively. As a result, gelation of the surface treatment liquid occurs. Therefore, according to the present invention, a bifunctional isocyanate compound is used as an isocyanate compound, since the isocyanate compound can desirably react with a bifunctional polyol and a trifunctional polyol.

Examples of the bifunctional polyol include ethylene glycol (EG), diethylene glycol (DEG), propylene glycol (PG), 1,3-propanediol (PDO), 1,4-butanediol (BD), and 1,4-hexanediol (HD). Among such bifunctional polyols, a bifunctional polyol having a molecular weight of 150 or lower is preferably used. Among the above bifunctional polyols, 1,3-propanediol (PDO) and 1,4-butanediol (BD) are preferably used. When a bifunctional polyol having a molecular weight of 150 or lower is used, reaction between the bifunctional polyol and an isocyanate is accelerated, whereby a treated surface layer having high hardness can be efficiently formed.

Examples of the trifunctional polyol include trifunctional aliphatic polyols such as glycerin, 1,2,4-butanetriol, trimethylolethane (TME), trimethylolpropane (TMP), and 1,2,6-hexanetriol; polyether triols formed through addition of ethylene oxide, butylene oxide or the like to a trifunctional aliphatic polyol; and polyester triols formed through addition of a lactone or the like to a trifunctional aliphatic polyol. Among such trifunctional polyols, a trifunctional polyol having a molecular weight of 150 or lower is preferably used. Among the above trifunctional polyols, trimethylolethane (TME) and trimethylolpropane (TMP) are preferably used. When a trifunctional polyol having a molecular weight of 150 or lower is used, hydroxyl groups of a trifunctional polyol react with isocyanate groups, to thereby form the treated surface layer 11 having a high-crosslinking-density 3-dimensional structure.

More preferably, the surface treatment liquid contains both the aforementioned bifunctional polyol and trifunctional polyol. In addition, the ratio in functional group number of bifunctional polyol to trifunctional polyol (number of bifunctional groups/number of trifunctional groups) is preferably 50/50 to 95/5. Under these conditions, reaction between the polyols and an isocyanate is accelerated, to thereby form the treated surface layer 11 having a high-crosslinking-density, high-hardness 3-dimensional structure.

The ratio of isocyanate groups present in the bifunctional isocyanate compound of the surface treatment liquid to hydroxyl groups present in at least one species selected from the bifunctional polyol and the trifunctional polyol (NCO groups/OH groups) is preferably 1.0 to 1.5. When the isocyanate/hydroxyl (NCO groups/OH groups) ratio is smaller than 1.0, unreacted bifunctional polyol or trifunctional polyol remains, to thereby cause whitening and softening, whereas when the ratio is in excess of 1.5, unreacted isocyanate remains, to thereby cause browning.

No particular limitation is imposed on the organic solvent, so long as it can dissolve the aforementioned isocyanate compound, bifunctional polyol, and trifunctional polyol. However, an organic solvent having no active hydrogen which can react with an isocyanate compound is suitably used. Examples of the organic solvent include methyl ethyl ketone (MEK), methyl isobutyl ketone (MIBK), tetrahydrofuran (THF), acetone, ethyl acetate, butyl acetate, toluene, and xylene, which can swell a urethane-based material. The organic solvent has higher solubility as the boiling point thereof decreases. Such a solvent can reduce the drying time after impregnation of the surface portion of the elastic body with the surface treatment liquid. As a result, uniform treatment can be attained. Notably, these organic solvents are appropriately chosen in accordance with the degree of swelling of the elastic body 10. Thus, methyl ethyl ketone (MEK), acetone, and ethyl acetate are preferably used.

The elastic body 10 is formed of a urethane elastomer. Examples of the urethane elastomer include urethane elastomers mainly formed from at least one member selected from among an aliphatic polyether, an aliphatic polyester, and an aliphatic polycarbonate. One specific example is a urethane elastomer formed via urethane bonding mainly of a polyol at least one member selected from among an aliphatic polyether, an aliphatic polyester, and an aliphatic polycarbonate. Examples of preferred polyurethanes include polyether polyurethanes, polyester polyurethanes, and polycarbonate polyurethanes. Such a urethane elastomer preferably has an Asker A hardness of 70 or lower. In this case, the affinity of the polyurethane with the bifunctional isocyanate compound can be enhanced, and integration of the treated surface layer 11 to the elastic body 10 via bonding is promoted. Notably, the elastic body employed may also be formed via polyamide bonding, ester bonding, or the like, instead of urethane bonding. Alternatively, a thermoplastic elastomer such as polyether-amide or polyether-ester may also be used. In addition to or instead of a urethane resin including active hydrogen, a filler or a plasticizer including active hydrogen may be used.

The aforementioned elastic body preferably has a Shore A hardness of 70 or lower. When the elastic body 10 has such a hardness, flexibility is ensured in a portion near the contact portion, to thereby attain excellent cleaning performance. However, if the hardness increases excessively, flexibility is poor, and cleaning performance is impaired.

Thus, the treated surface layer 11 is formed by impregnating the surface portion of the elastic body 10 with the surface treatment liquid, and curing the surface treatment liquid.

No particular limitation is imposed on the method for impregnating the surface portion of the elastic body 10 with the surface treatment liquid and curing. In one impregnation method, the elastic body 10 is immersed in a surface treatment liquid and then heated. In an alternative method, the surface treatment liquid is applied, through spraying or a similar technique, onto the surface of the elastic body 10 for impregnation, and then the elastic body is heated. No particular limitation is imposed on the heating method, and examples thereof include heating, forced drying, and drying under ambient conditions.

In one specific case in which the surface treatment liquid contains an isocyanate compound, at least one member selected from a bifunctional polyol and a trifunctional polyol, and an organic solvent is used, formation of the treated surface layer 11 proceeds via the following: reaction of the isocyanate compound and the polyols during impregnation of the surface portion of the elastic body 10 with the surface treatment liquid, formation of a prepolymer, curing of the prepolymer, and reaction of the isocyanate groups with the elastic body 10.

In another case in which a prepolymer is used as a surface treatment liquid, the isocyanate compound and the bifunctional polyol or the trifunctional polyol present in the surface treatment liquid are caused to be reacted under specific conditions, to thereby convert the surface treatment liquid into a prepolymer having an isocyanate group at an end thereof. In this case, formation of the treated surface layer 11 proceeds via the following: impregnation of the surface portion of the elastic body 10 with the surface treatment liquid, curing of the prepolymer, and reaction of the isocyanate groups with the elastic body 10. Such formation of a prepolymer from the isocyanate compound with the bifunctional polyol or the trifunctional polyol may occur during impregnation of the surface portion of the elastic body 10 with the surface treatment liquid. The extent of reaction may be controlled by regulating reaction temperature, reaction time, and post-reaction conditions. Preferably, the reaction is performed at a surface treatment liquid of 5° C. to 35° C. and a humidity of 20% to 70%. If required, a crosslinking agent, a catalyst, a curing agent, and other additives are optionally added to the surface treatment liquid.

According to the present invention, the surface portion included in the treated surface layer of the elastic body is impregnated with a surface treatment liquid formed of a mixture containing a bifunctional isocyanate compound, at least one polyol selected from a bifunctional polyol and a trifunctional polyol, and an organic solvent, or a surface treatment liquid formed of a prepolymer obtained from the above components, whereby the produced cleaning blade has a treated surface layer having a difference between the nitrogen concentration at the surface of the treated surface layer and the nitrogen concentration in the elastic body at a depth of 0.5 mm from the surface of the treated surface layer is 0.02 to 0.15 mass %. As a result, only the surface portion of the elastic body is hardened to have a high density without impairing the total flexibility, to thereby attain the reliability of the cleaning blade which can ensure excellent cleaning performance for a long period of time. In addition, since the treated surface layer is formed to be a very thin layer, a step of forming a coating layer on the surface of the elastic body can be omitted in the cleaning blade production procedure. Thus, no step of removing a coating layer is needed.

EXAMPLES

The present invention will next be described in detail by way of examples, which should not be construed as limiting the invention thereto.

Cleaning blades each produced via a surface treatment of the surface portion of the urethane elastic body with a surface treatment liquid containing at least one member selected from a bifunctional polyol and a trifunctional polyol were produced (Examples 1 to 6, and Comparative Examples 1 and 2). Also, cleaning blades each produced via a surface treatment of the surface portion of the urethane elastic body with a surface treatment liquid containing no polyol (Comparative Examples 3 to 5), and cleaning blades each produced via no surface treatment (Comparative Examples 7 and 8) were produced through the following procedures.

Example 1

Production of Urethane Elastic Body

Caprolactone polyol (molecular weight: 2,000) (100 parts by mass) serving as a polyol was reacted with 4,4'-diphenylmethane diisocyanate (MDI) (38 parts by mass) serving as an isocyanate compound at 115° C. for 20 minutes. Then, 1,4-butanediol (6.1 parts by mass) and trimethylollpropane (2.6 parts by mass) serving as cross-linking agents were added to the reaction system. The resultant mixture was cured in a metal mold maintained at 140° C. for 40 minutes. After molding, the molded product was cut into urethane elastic bodies each having a width of 12.3 mm, a thickness of 2.0 mm, and a length of 324 mm.

Preparation of Surface Treatment Liquid

A bifunctional isocyanate compound MDI (product of Nippon Polyurethane Industry Co., Ltd., molecular weight: 250.25) as an isocyanate compound, a trifunctional polyol TMP (product of Nippon Polyurethane Industry Co., Ltd., molecular weight: 134.17) as a polyol, and methyl ethyl ketone (MEK) were mixed together, so as to adjust the ratio of isocyanate group to hydroxyl group (NCO group/OH group) to 1.0, to thereby prepare a 5-mass % surface treatment liquid. The content concentration of the surface treatment liquid (mass %) is defined as a ratio of the total mass of isocyanate compound and polyol to the mass of the entire surface treatment liquid.

Surface Treatment of Urethane Elastic Body

While the surface treatment liquid was maintained at 23° C., the urethane elastic body was immersed in the surface treatment liquid for 1 minute, and then heated in an oven maintained at 50° C. for 1 hour. Subsequently, the thus-surface-treated urethane elastic body was joined to a supporting member, to thereby fabricate a cleaning blade. As a result, the produced cleaning blade had a treated surface layer having a thickness of 10 μm at a surface portion and a difference between the nitrogen concentration at the surface of the treated surface layer and the nitrogen concentration in the elastic body at a depth of 0.5 mm from the surface of the treated surface layer (hereinafter may be referred to as nitrogen concentration difference of the treated surface layer between surface and inside) of 0.05 mass %.

The thickness of the treated surface layer was measured by means of a Dynamic Micro-hardness meter (product of Shimadzu Corporation) in accordance with JIS Z2255 and ISO 14577. In a specific procedure, firstly, the surface hardness of the urethane elastic body was measured. Then, the surface-treated urethane elastic body was cut, and the cut surface was subjected to hardness measurement from the surface of the cut surface to the inside of the urethane elastic body. The depth at which the relative hardness with respect to the hardness at a depth from the surface of 10 μm exceeded 30% was determined. The thus-obtained distance from the surface to the depth was employed as the thickness of the treated surface layer.

The difference in nitrogen concentration between the surface and the inside (a cut depth of 0.5 mm) of the treated surface layer was determined by means of EPMA JXA-8100 (product of JEOL Ltd.).

Example 2

Fabrication of Urethane Elastic Body

The procedure of Example 1 was repeated, to thereby fabricate a urethane elastic body.

Preparation of Surface Treatment Liquid

The procedure of Example 1 was repeated, except that the components were mixed together, so as to adjust the ratio of isocyanate group in bifunctional isocyanate to hydroxyl group in trifunctional polyol (NCO group/OH group) to 1.2, to thereby prepare a 10-mass % surface treatment liquid.

Surface Treatment of Urethane Elastic Body

The urethane elastic body was subjected to the same surface treatment with a surface treatment liquid as performed in Example 1. Subsequently, the thus-surface-treated urethane elastic body was joined to a supporting member, to thereby fabricate a cleaning blade. As a result, the produced cleaning blade had a treated surface layer having a thickness of 30 μm at a surface portion and a nitrogen concentration difference of the treated surface layer between surface and inside of 0.05 mass %.

Example 3

Fabrication of Urethane Elastic Body

The procedure of Example 1 was repeated, to thereby fabricate a urethane elastic body.

Preparation of Surface Treatment Liquid

The procedure of Example 1 was repeated, except that the components were mixed together, so as to adjust the ratio of isocyanate group in bifunctional isocyanate to hydroxyl group in trifunctional polyol (NCO group/OH group) to 1.5, to thereby prepare a 15-mass % surface treatment liquid.

Surface Treatment of Urethane Elastic Body

The urethane elastic body was subjected to the same surface treatment with a surface treatment liquid as performed in Example 1. Subsequently, the thus-surface-treated urethane elastic body was joined to a supporting member, to thereby fabricate a cleaning blade. As a result, the produced cleaning blade had a treated surface layer having a thickness of 50 μm at a surface portion and a nitrogen concentration difference of the treated surface layer between surface and inside of 0.05 mass %.

Example 4

Fabrication of Urethane Elastic Body

The procedure of Example 1 was repeated, to thereby fabricate a urethane elastic body.

Preparation of Surface Treatment Liquid

The procedure of Example 1 was repeated, except that a bifunctional polyol 1,3-propanediol (PDO) (product of Kanto Kagaku, molecular weight: 76.09) and a trifunctional polyol TMP (product of Nippon Polyurethane Industry Co., Ltd., molecular weight: 134.17) were used as polyols, to thereby prepare a surface treatment liquid. The ratio of isocyanate groups present in the bifunctional isocyanate compound to hydroxyl groups present in the bifunctional polyol and trifunctional polyol (NCO group/OH group) was adjusted to 1.2, to thereby prepare a 10-mass % surface treatment liquid. The functional group number ratio of bifunctional polyol to trifunctional polyol (number of bifunctional groups/number of trifunctional groups) was adjusted to 40/60.

Surface Treatment of Urethane Elastic Body

The urethane elastic body was subjected to the same surface treatment with a surface treatment liquid as performed in Example 1. Subsequently, the thus-surface-treated urethane elastic body was joined to a supporting member, to thereby fabricate a cleaning blade. As a result, the produced cleaning blade had a treated surface layer having a thickness of 30 μm at a surface portion and a nitrogen concentration difference of the treated surface layer between surface and inside of 0.07 mass %.

Example 5

Fabrication of Urethane Elastic Body

The procedure of Example 1 was repeated, to thereby fabricate a urethane elastic body.

Preparation of Surface Treatment Liquid

The procedure of Example 4 was repeated, except that a bifunctional polyol 1,3-propanediol (PDO) (product of Kanto Kagaku, molecular weight: 76.09) and a trifunctional polyol TMP (product of Nippon Polyurethane Industry Co., Ltd., molecular weight: 134.17) were used as polyols. The functional group number ratio of bifunctional polyol to trifunctional polyol (number of bifunctional groups/number of trifunctional groups) was adjusted to 85/15. Thus, the surface treatment liquid of Example 5 was prepared.

Surface Treatment of Urethane Elastic Body

The procedure of the surface treatment as employed in Example 4 was repeated. Subsequently, the thus-surface-treated urethane elastic body was joined to a supporting member, to thereby fabricate a cleaning blade. As a result, the produced cleaning blade had a treated surface layer having a thickness of 30 μm at a surface portion and a nitrogen concentration difference of the treated surface layer between surface and inside of 0.10 mass %.

Example 6

Fabrication of Urethane Elastic Body

The procedure of Example 1 was repeated, to thereby fabricate a urethane elastic body.

Preparation of Surface Treatment Liquid

The procedure of Example 4 was repeated, except that a bifunctional polyol 1,3-propanediol (PDO) (product of Kanto Kagaku, molecular weight: 76.09) was used as a polyol, to thereby prepare a surface treatment liquid.

Surface Treatment of Urethane Elastic Body

The procedure of the surface treatment as employed in Example 4 was repeated. Subsequently, the thus-surface-treated urethane elastic body was joined to a supporting member, to thereby fabricate a cleaning blade. As a result, the produced cleaning blade had a treated surface layer having a thickness of 30 μm at a surface portion and a nitrogen concentration difference of the treated surface layer between surface and inside of 0.10 mass %.

Comparative Example 1

Fabrication of Urethane Elastic Body

The procedure of Example 1 was repeated, to thereby fabricate a urethane elastic body.

Preparation of Surface Treatment Liquid

The procedure of Example 2 was repeated, except that the concentration of the prepared surface treatment liquid was altered to 30 mass %.

Surface Treatment of Urethane Elastic Body

The procedure of the surface treatment as employed in Example 2 was repeated, except that the urethane elastic body was immersed in the surface treatment liquid for 30 minutes. Subsequently, the thus-surface-treated urethane elastic body was joined to a supporting member, to thereby fabricate a cleaning blade. As a result, the produced cleaning blade had a treated surface layer having a thickness of 150 μm at a surface portion and a nitrogen concentration difference of the treated surface layer between surface and inside of 0.5 mass %.

Comparative Example 2

Fabrication of Urethane Elastic Body

The procedure of Example 1 was repeated, to thereby fabricate a urethane elastic body.

Preparation of Surface Treatment Liquid

A surface treatment liquid was prepared through the same procedure as employed in Example 2.

Surface Treatment of Urethane Elastic Body

The procedure of the surface treatment as employed in Example 2 was repeated, except that the urethane elastic body was immersed in the surface treatment liquid for 18 seconds. Subsequently, the thus-surface-treated urethane elastic body was joined to a supporting member, to thereby fabricate a cleaning blade. As a result, the produced cleaning blade had a treated surface layer having a thickness of 5 μm at a surface portion and a nitrogen concentration difference of the treated surface layer between surface and inside of 0.01 mass %.

Comparative Example 3

Fabrication of Urethane Elastic Body

The procedure of Example 1 was repeated, to thereby fabricate a urethane elastic body.

Preparation of Surface Treatment Liquid

The procedure of Example 2 was repeated, except that the surface treatment liquid contained no polyol, and the concentration of the prepared surface treatment liquid was altered to 20 mass %.

Surface Treatment of Urethane Elastic Body

The procedure of the surface treatment as employed in Example 1 was repeated, except that the urethane elastic body was immersed in the surface treatment liquid for 1 minute. Subsequently, the thus-surface-treated urethane elastic body was joined to a supporting member, to thereby fabricate a cleaning blade. As a result, the produced cleaning blade had a treated surface layer having a thickness of 3 μm at a surface portion and a nitrogen concentration difference of the treated surface layer between surface and inside of 0.7 mass %.

Comparative Example 4

Fabrication of Urethane Elastic Body

The procedure of Example 1 was repeated, to thereby fabricate a urethane elastic body.

Preparation of Surface Treatment Liquid

The procedure of Example 2 was repeated, except that the surface treatment liquid contained no trifunctional polyol to thereby prepare a surface treatment liquid.

Surface Treatment of Urethane Elastic Body

The procedure of the surface treatment as employed in Example 1 was repeated, except that the urethane elastic body was immersed in the surface treatment liquid for 1 minute. Subsequently, the thus-surface-treated urethane elastic body was joined to a supporting member, to thereby fabricate a cleaning blade. As a result, the produced cleaning blade had a treated surface layer having a thickness of 20 μm at a surface portion and a nitrogen concentration difference of the treated surface layer between surface and inside of 1.0 mass %.

Comparative Example 5

A urethane elastic body was formed through the same procedure as employed in Example 1. No surface treatment was performed to the urethane elastic body, and the thus-produced urethane elastic body was joined to a supporting member, to thereby fabricate a cleaning blade.

Test Example 1

<Measurement of Dynamic Friction Coefficient>

Dynamic friction coefficient of each blade piece was measured by means of a surface property tester (product of Shinto Scientific Co., Ltd.) in accordance with JIS K7125, P8147, and ISO 8295. An SUS304 steel ball (diameter: 10 mm) was used as a counter friction member. The dynamic friction coefficient was measured at a moving speed of 50 mm/min, a load of 0.49 N, and an amplitude of 50 mm. Tables 1 and 2 show the results.

Test Example 2

<Measurement of Indentation Elastic Modulus>

Indentation elastic modulus of each blade piece was measured by means of a dynamic ultramicro hardness meter (product of Shimadzu Corporation) in accordance with ISO 14577. A load-unload test was conducted at a retention time of 5 s, a maximum load of 0.98 N, and a loading speed of 0.14 N/s, whereby the indentation elastic modulus at a depth from the top surface of the treated surface layer (e.g., 10 μm in the case of sample 1) was determined. Tables 1 and 2 show the results.

Test Example 3

<Measurement of Surface Hardness>

Each blade piece was subjected to by an indentation test means of a dynamic ultramicro hardness meter (product of Shimadzu Corporation) in accordance with JIS Z2255 and ISO 14577. The hardness of the surface of the test blade piece was determined at a loading speed of 1.4 mN/s and a measurement depth of 10 μm. Tables 1 and 2 show the results.

Test Example 4

<Measurement of Surface Roughness>

Ten-point mean surface roughness ($R_z$) of each blade piece was determined by means of Surfcom 1400A (product of Toyo Seimitus Co., Ltd.) in accordance with JIS B0601-1994. Specifically, the roughness of each rubber elastic body was measured at a moving speed of 0.15 mm/s, a cut-off wavelength of 0.8 mm, a loading speed of 1.4 mN/s, and a measurement depth of 10 μm. Tables 1 and 2 show the results.

Test Example 5

<Cleaning Performance>

Each test blade was attached to a cartridge, and the cartridge was employed in an A3-size color multifunction peripheral (MFP) (55 sheets/min). A printing job (1,000,000 sheets) was conducted. The cleaning performance after the printing job was assessed as "O" when no break-through of toner was observed, and as "X" when any break-through of toner was observed. Tables 1 and 2 show the results.

Test Example 6

<Suppression of Filming>

Each test blade was attached to a cartridge, and the cartridge was employed in an A3-size color multifunction peripheral (MFP) (55 sheets/min). A printing job (1,000,000 sheets) was conducted. The filming suppression property after the printing job was assessed as "O" when no adhesion of toner was observed, as "Δ" when slight (but practically not problematic) adhesion of toner was observed, and as "X" when any adhesion of toner was observed. Tables 1 and 2 show the results.

Test Example 7

<Wear Resistance>

Each test blade was attached to a cartridge, and the cartridge was employed in an A3-size color multifunction peripheral (MFP) (55 sheets/min). A printing job (1,000,000 sheets) was conducted. The wear resistance after the printing job was assessed as "O" when no chipping or wear was observed, as "Δ" when slight chipping or wear (but not problematic in practice) was observed, and as "X" when any chipping or wear was observed. Tables 1 and 2 show the results.

Test Example 8

<Appearance of Printed Sheet>

Each test blade was attached to a cartridge, and the cartridge was employed in an A3-size color multifunction peripheral (MFP) (55 sheets/min). A printing job (1,000,000 sheets) was conducted. The appearance of the printed sheets after the printing job was assessed as "O" when no print failure was observed, and as "X" when any print failure was observed. Tables 1 and 2 show the results.

Test Example 9

<Life of Surface Treatment Liquid>

Each of the prepared surface treatment liquids (400 g) was placed in a 500-mL container, and the container was closed. The liquid was maintained at 40° C., and the time (days) until any change in appearance was observed was determined. The life of the surface treatment liquid was assessed as "O" when no change in appearance was observed for 2 days or longer, and as "X" when any change in appearance was observed within 2 days. Tables 1 and 2 show the results.

TABLE 1

| | | Ex. 1 | Ex. 2 | Ex. 3 | Ex. 4 | Ex. 5 | Ex. 6 |
|---|---|---|---|---|---|---|---|
| | | Bifunctional isocyanate compd. + polyol | | | | | |
| | Polyol function (bi/tri mole ratio) | trifunction (0/100) | | | bi-/tri-function (40/60) | bi-/tri-function (85/15) | bii-function (100/0) |
| Blend ratio | NCO/OH | 1.0 | 1.2 | 1.5 | 1.2 | 1.2 | 1.2 |
| | Concn. (wt. %) | 5 | 10 | 15 | 10 | 10 | 10 |
| Treatment conditions | Impregnation thickness (μm) | 10 | 30 | 50 | 30 | 30 | 30 |
| | N concn. difference (wt. %) (surface and 0.5 mm depth) | 0.05 | 0.05 | 0.05 | 0.07 | 0.10 | 0.10 |
| | Time (min) | 1 | 1 | 1 | 1 | 1 | 1 |
| Evaluation | (1) Dynamic friction coeff. | 1.9 | 1.7 | 1.5 | 1.6 | 1.6 | 1.6 |
| | (2) Indentation elastic modulus (MPa) | 8 | 9 | 10 | 10 | 13 | 11 |
| | (3) Surface hardness | 0.10 | 0.10 | 0.10 | 0.10 | 0.12 | 0.10 |
| | (4) Surface roughness Rz (μm) | 0.4 | 0.3 | 0.3 | 0.3 | 0.4 | 0.3 |
| | (5) Cleaning performance | ○ | ○ | ○ | ○ | ○ | ○ |
| | (6) Filming resistance | Δ | Δ | Δ | Δ | ○ | Δ |
| | (7) Blade wear resistance | Δ | Δ | ○ | ○ | ○ | ○ |
| | (8) Appearance | ○ | ○ | ○ | ○ | ○ | ○ |
| | (9) Life of surface treatment liquid | ○ 14 days | ○ 6 days | ○ 2 days | ○ 2 days | ○ 2 days | ○ 2 days |

TABLE 2

| | | Comp. Ex. 1 | Comp. Ex. 2 | Comp. Ex. 3 | Comp. Ex. 4 | Comp. Ex. 5 |
|---|---|---|---|---|---|---|
| | | Bifunctional isocyanate compd. + polyol | | (Polyisocyanate) | | (Substrate) |
| | Polyol function (bi/tri mole ratio) | trifunction (0/100) | | | | |
| Blend ratio | NCO/OH | 1.2 | 1.2 | — | — | — |
| | Concn. (wt. %) | 30 | 10 | 20 | 30 | — |
| Treatment conditions | Impregnation thickness (μm) | 150 | 5 | 3 | 20 | — |
| | N concn. difference (wt. %) (surface and 0.5 mm depth) | 0.5 | 0.01 | 0.7 | 1.0 | 0 |
| | Time (min) | 30 | 0.3 | 1 | 1 | — |
| Evaluation | (1) Dynamic friction coeff. | 1.0 | 2.3 | 2.5 | 2.0 | 3.5 |
| | (2) Indentation elastic modulus (MPa) | 10 | 6 | 6 | 9 | 6 |
| | (3) Surface hardness | 0.11 | 0.09 | 0.09 | 0.10 | 0.09 |
| | (4) Surface roughness Rz (μm) | 1.3 | 0.4 | 0.5 | 2.2 | 0.4 |
| | (5) Cleaning performance | X | ○ | ○ | X | ○ |
| | (6) Filming resistance | ○ | X | X | ○ | X |
| | (7) Blade wear resistance | ○ | X | X | ○ | X |
| | (8) Appearance | X | ○ | ○ | X | ○ |
| | (9) Life of surface treatment liquid | X 1 day | ○ 14 days | ○ 6 days | X 1 day | — |

INDUSTRIAL APPLICABILITY

The cleaning blade of the present invention is suitably employed as a cleaning blade, a conductive roller, a transfer belt, or the like, which is employed in an image-forming device such as an electrophotographic copying machine or printer, or a toner-jet copying machine or printer. However, the use is not limited to the above. For example, the cleaning blade of the present invention may be used as rubber parts such as sealing member, a rubber hose for industrial use, a rubber belt for industrial use, a wiper, an automobile weather strip, and a glass run channel.

DESCRIPTION OF REFERENCE NUMERALS

1: cleaning blade
10: elastic body
11: treated surface layer
20: supporting member

The invention claimed is:

1. A cleaning blade, comprising:
an elastic body formed of a urethane elastomer; and
a treated surface layer formed at least at a portion which comes into contact with a contact target of the elastic body, wherein:
the treated surface layer is formed through impregnating a surface portion of the elastic body with a surface treatment liquid containing a bifunctional isocyanate compound having a molecular weight of 200 to 300, at least one polyol selected from a bifunctional polyol and a trifunctional polyol having a molecular weight of 150 or lower, and an organic solvent; or a surface treatment liquid containing an isocyanate group-containing compound having an isocyanate group at an end thereof, which compound is a reaction product of the bifunctional isocyanate compound with said at least one polyol selected from a bifunctional polyol and a trifunctional polyol, and an organic solvent, and curing the surface treatment liquid; and
a difference between a nitrogen concentration at a surface of the treated surface layer and the nitrogen concentration in the treated surface layer at a depth of 0.5 mm from the surface of the treated surface layer is 0.02 to 0.15 mass %.

2. The cleaning blade according to claim 1, wherein the treated surface layer has a thickness of 10 μm to 100 μm.

3. The cleaning blade according to claim 2, wherein a ratio of isocyanate groups present in the bifunctional isocyanate compound of the surface treatment liquid to hydroxyl groups present in said at least one polyol selected from the bifunctional polyol and the trifunctional polyol (NCO groups/OH groups) is 1.0 to 1.5.

4. The cleaning blade according to claim 3, wherein:
the surface treatment liquid contains the bifunctional polyol and the trifunctional polyol, and
a ratio in functional group number of bifunctional polyol to trifunctional polyol (number of bifunctional groups/number of trifunctional groups) is 50/50 to 95/5.

5. The cleaning blade according to claim 2, wherein:
the surface treatment liquid contains the bifunctional polyol and the trifunctional polyol, and
a ratio in functional group number of bifunctional polyol to trifunctional polyol (number of bifunctional groups/number of trifunctional groups) is 50/50 to 95/5.

6. The cleaning blade according to claim 1, wherein a ratio of isocyanate groups present in the bifunctional isocyanate compound of the surface treatment liquid to hydroxyl groups present in said at least one polyol selected from the bifunctional polyol and the trifunctional polyol (NCO groups/OH groups) is 1.0 to 1.5.

7. The cleaning blade according to claim 6, wherein:
the surface treatment liquid contains the bifunctional polyol and the trifunctional polyol, and
a ratio in functional group number of bifunctional polyol to trifunctional polyol (number of bifunctional groups/number of trifunctional groups) is 50/50 to 95/5.

8. The cleaning blade according to claim 1, wherein:
the surface treatment liquid contains the bifunctional polyol and the trifunctional polyol, and
a ratio in functional group number of bifunctional polyol to trifunctional polyol (number of bifunctional groups/number of trifunctional groups) is 50/50 to 95/5.

* * * * *